United States Patent [19]

Belding

[11] 4,248,671

[45] Feb. 3, 1981

[54] DRY COKE QUENCHING AND POLLUTION CONTROL

[75] Inventor: John Belding, Branford, Conn.

[73] Assignee: Envirotech Corporation, Menlo Park, Calif.

[21] Appl. No.: 27,190

[22] Filed: Apr. 4, 1979

[51] Int. Cl.[3] ..... C10B 39/02; C10B 39/14

[52] U.S. Cl. ..... 202/228; 201/39; 202/263

[58] Field of Search ..... 201/39; 202/227, 228, 202/263

[56] References Cited

U.S. PATENT DOCUMENTS

| | | | |
|---|---|---|---|
| 2,795,539 | 6/1957 | Hughes | 202/228 X |
| 3,331,754 | 7/1967 | Mansfield . | |
| 3,715,282 | 2/1973 | Pries et al. . | |
| 3,774,315 | 11/1973 | Schmalfeld et al. | 201/39 X |
| 3,809,619 | 5/1974 | Drebes et al. | 201/39 |
| 3,843,461 | 10/1974 | Allen | 202/227 |
| 3,869,352 | 3/1975 | Allen et al. | 202/227 |
| 3,959,084 | 5/1976 | Price | 201/39 |
| 4,147,594 | 4/1979 | Cain et al. | 201/39 |

OTHER PUBLICATIONS

Linsky, B., Littlepage, J., Johanes, A., Nekooi, R. and Lincoln, P. *Dry Coke Quenching, Air Pollution and Energy: A Status Report.* In Journal of the Air Pollution Conrol Association. 25(9): p. 918–924. 09001975.

Voelker, F. C., Jr. *A Contemporary Survey of Coke-Oven Air Emissions Abatement.* In Iron & Steel Engineer. 02001975.

*Primary Examiner*—Frank W. Lutter
*Assistant Examiner*—Roger F. Phillips
*Attorney, Agent, or Firm*—Michael Pollock; Hal Bohner

[57] ABSTRACT

A system and method are provided for dry quenching coke while simultaneously eliminating pollutants emitted during coke pushing and quenching operations. The method includes pushing the hot coke from a coke oven into a hooded, mobile coke quench car, drawing the pollutants emitted during the push downwardly through the hot coke contained in the quench car to oxidize the pollutants and produce an inert combustion gas, cooling the hot inert gas and utilizing the heat recovered from the gas, cleaning the cooled inert gas, and returning the cooled cleaned inert gas to the quench car for further passage through the hot coke.

6 Claims, 7 Drawing Figures

DRY COKE QUENCHING AND POLLUTION CONTROL

BACKGROUND OF THE INVENTION

1. Field of the Invention

This invention relates to coke quenching systems and more particularly to a mobile coke quenching system wherein dry quenching is utilized to cool hot coke while pollutants emitted during coke pushing and quenching operations are substantially eliminated.

2. State of the Art

Growing concern over environmental pollution has focused on a number of industrial operations that result in substantial gaseous and particulate matter emissions. Receiving increasing attention are coke pushing and quenching operations, since the pollutants emitted from these operations have been reported to be potentially carcinogenic.

In the coke industry, the word "pushing" usually refers to that portion of the conventional coke-making process during which hot, incandescent coke is discharged from a coke oven into a mobile receiving car, or quench car, which is located adjacent the oven. As the coke falls into the quench car, it breaks up and a substantial quantity of highly polluting emissions is generated. These emissions continue as the quench car transports the hot coke to a quench tower.

The word "quenching" usually refers to that portion of the coke-making procedure during which a quench car is at rest under a "quench tower" while the incandescent coke contained in the quench car is doused with tons of water. During this wet quenching operation, large amounts of air polluting emissions are generated by the reaction of the quench water and the incandescent coke. These emissions rise into the atmosphere together with the large volumes of steam which are also generated during the operation.

In one conventional method of controlling emissions resulting from coke quenching operations, coked coal is pushed from a coke oven into the bed of a special "hooded" quench car. The quench car is typically provided with a draft-inducing mechanism for drawing these emissions upwardly from the quench car into a collection hood which overlies the car. The collected emissions are then passed through a gas cleaning system in which the pollutants are removed. A wet scrubber system is normally used for this purpose. A quench car of the type just described is taught by the J. E. Allen U.S. Pat. No. 3,843,461 and by the J. E. Allen et al U.S. Pat. No. 3,869,352.

In another type of mobile quench car, after the hot coke has been pushed into the car, it is cooled by introducing steam or inert gases from a source external to the quench car to the bottom of the closed car. The gases rise upwardly through the hot coke and are discharged to the atmosphere through a vent or waste gas stack located at the top of the car. A quench car of this type is taught by the Hughes U.S. Pat. No. 2,795,539.

SUMMARY AND OBJECTS OF THE INVENTION

It is the primary object of this invention to provide a new and improved coke quench car which utilizes dry quenching to cool hot coke while simultaneously substantially eliminating pollutants emitted during coke pushing and quenching operations.

The present invention achieves the foregoing by providing a mobile coke quench car having a coke receiving box for receiving hot coke and a gas-tight hood mounted above the receiving box. The hood includes means for opening same to allow hot coke to enter the coke receiving box. However, the hood is normally closed to prevent the intrusion of air into the receiving box. A draft inducer is provided which is connected in gaseous flow communication with the coke receiving box to draw gases from within the coke receiving box downwardly through the hot coke contained therein. As the gases pass through the hot coke, destruction of pollutants contained in the gases occurs by oxidation and an inert gas is produced. The resulting inert gas is discharged from the bottom of the coke receiving box. Preferably, these inert gases are discharged through a heat exchanger to recover heat therefrom; the gases are then cleaned and returned to the coke receiving box to be utilized in further dry quenching of the coke. Recirculation of the inert gases in the preferred closed system may continue until the temperature of the coke in the receiving box is reduced to the desired level.

In some circumstances, it is possible that dry quenching by inert gases alone will not be sufficient to cool the coke in the receiving box to the desired temperature. Thus, water nozzles are provided to allow water to be sprayed into the coke receiving box for the purpose of wet quenching the coke. This supplementary wet quenching occurs while the quench car is closed and follows the initial phase of inert gas, dry quenching.

A major advantage of the present invention over the prior art is that with the coke quenched entirely in the quench car, the quench tower now employed in most coke quenching systems can be completely eliminated from the quenching process. Furthermore, the invention contemplates virtually complete capture of emissions from the hot coke. That is, pollutants emitted during the coke push are destroyed by oxidation; pollutants emitted during inert gas dry quenching are controlled by cleaning in the closed system; and pollutants emitted during the transport of the coke are similarly controlled.

In one embodiment of the invention, two separate quench cars are coupled in tandem so that each can receive a push of coke and quench the same in the manner described infra. This multiple quench car embodiment provides a total duration of quenching time approximately double the time normally elapsed between the beginning of a push from one oven and the beginning of the next push from another oven.

A further understanding of the present invention will be gained by reference to the following description and to the appended drawings, which are offered by way of illustration only and not in limitation of the invention, the scope of which is defined by the appended claims and equivalents to the structure, materials and acts recited therein.

DETAILED DESCRIPTION OF THE PREFERRED EMBODIMENT

Figure 1:
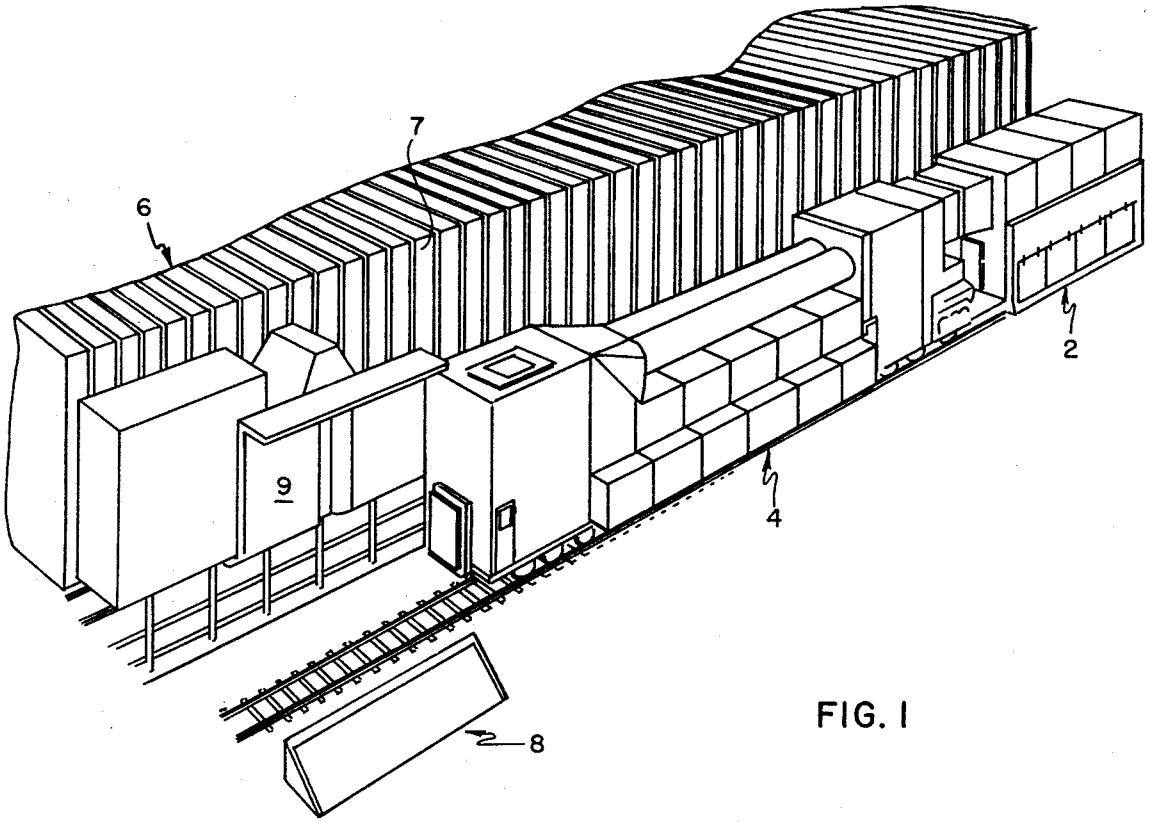
FIG. 1 is a pictorial view of a mobile coke quenching system according to the present invention.

As shown in FIG. 1, the coke quenching system of the present invention generally includes a mobile quench car 2 coupled to a control car 4. The quench car 2 and the control car 4 are movable as a unit between a battery 6 of parallel coke ovens 7 and a coke dumping wharf 8 whereat the coke is received in the quench car and thereafter dumped for further use, respectively. The coke dumping wharf 8 will ordinarily be in non-opposite relation to the coke oven battery 6 such as being spaced along a railroad right-of-way a distance dependent upon a particular installation. The control car 4 includes, as an integral part thereof, an engine which provides the force for movement of both the quench car 2 and the control car 4 between the aforementioned locations. The coke oven battery 6 is provided with a mobile coke guide 9 which is moved into position at the beginning of a push to provide a tubular passage through which the coke may pass from the exit of the coke oven 7 to the quench car 2.

Figure 2:
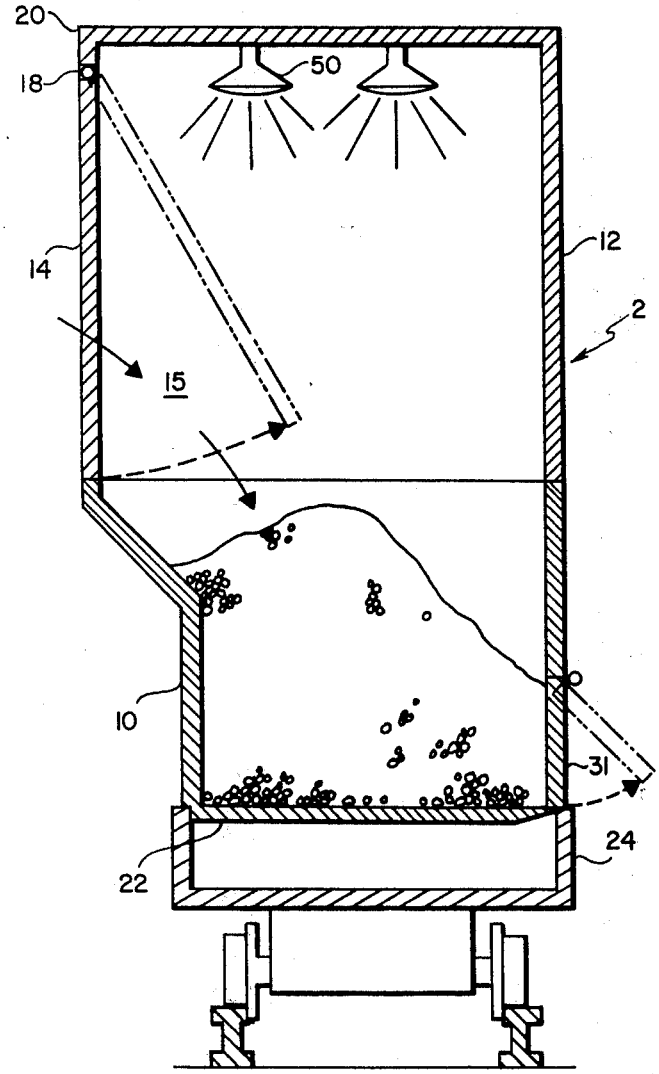
FIG. 2 is a vertical section taken through the width of the quench car 2 of FIG. 1.

Referring to FIG. 2, quench car 2 includes a generally open-topped coke receiving box 10 mounted thereon for receiving coke which has been pushed from a selected coke oven 7. Coke receiving box 10 is preferably of generally rectangular cross-section, extends the length of quench car 2, and is slightly larger in volume than the volume of coke contained in a coke oven 7. The quench car 2 also includes a gas-tight hood 12 which is mounted above the coke receiving box 10. Hood 12 includes means for opening the hood to allow hot coke to be pushed into coke receiving box 10 and for closing the hood immediately thereafter to prevent both the intrusion of air into coke receiving box 10 and the escape of gases therefrom. For example, in the embodiment illustrated in FIG. 2, hood 12 has formed as an integral part thereof pivotally mounted plates 14 which may be rotated inwardly, as indicated by the arrow by any suitable means. When the plates 14 are rotated inwardly, as shown by the dotted lines in FIG. 2, an opening 15 is formed to allow coke to enter therethrough to the coke receiving box 10. Plates 14 are rotatably mounted along a horizontal axis, such as at pivot 18, to the upper edge 20 of the coke-oven side of hood 12. That is, plates 14, when in the closed position, form a side wall of hood 12. Of course, those skilled in the art will recognize that other means for opening and closing hood 12 would be equally effective. For example, hood 12 can be constructed in the shape of a half-cylinder with a movable section which opens by rotation to allow pushed coke to enter coke receiving box 10 but closes immediately thereafter.

Coke receiving box 10 includes a generally planar coke grating 22 which extends the length of coke receiving box 10 and, in the preferred embodiment, is formed as the bottom of coke receiving box 10. Coke grating 22 has openings formed therein of such size and shape that gases and particulate matter contained in the gases may flow through the grating 22 but coke is prevented from passing therethrough.

Figure 4:
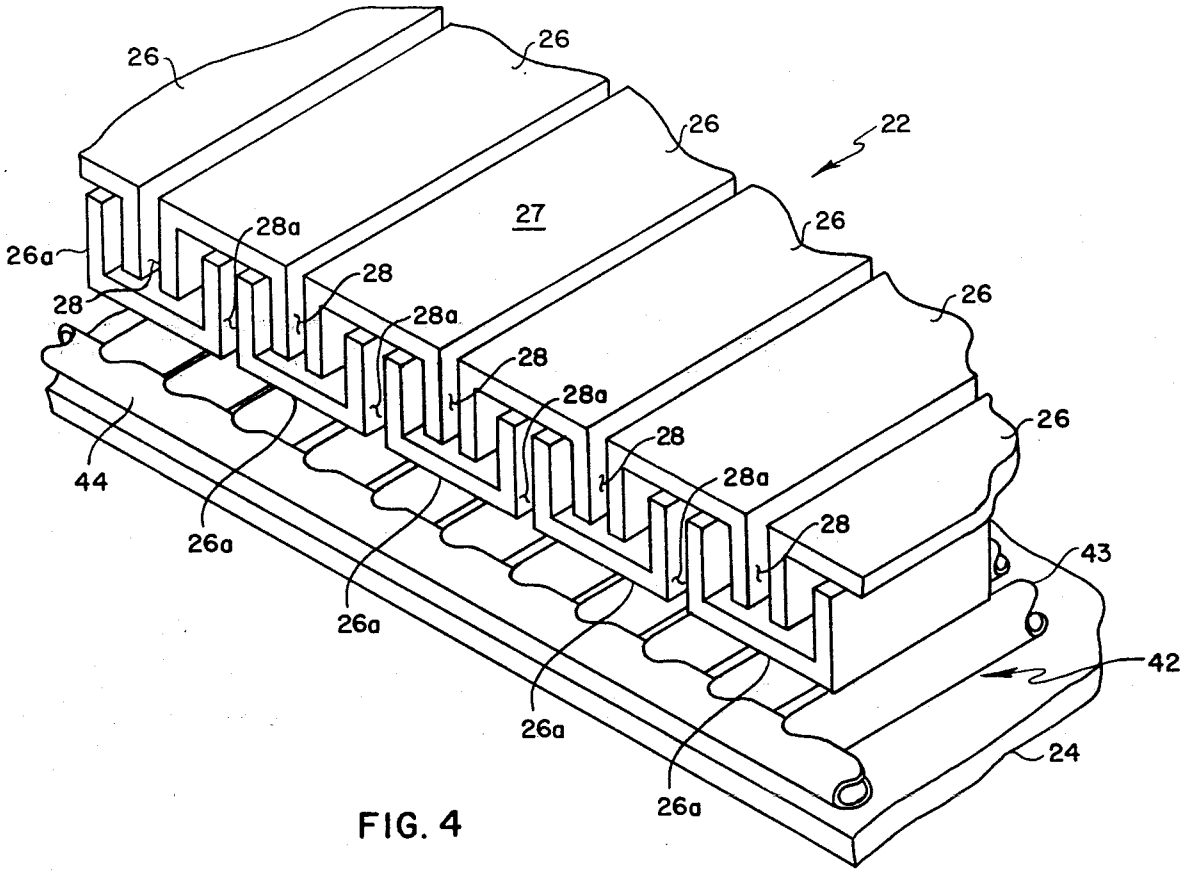
FIG. 4 is a partially cut-away perspective view of an embodiment of grating 22.

Referring to FIG. 4, grating 22 preferably comprises a first set of parallel generally U-shaped channel members 26 mounted transverse to the length of coke receiving box 10. The flanges of the channel members 26 are downwardly facing and slightly spaced-apart from the flanges of adjacent channel members 26 such that channel members 26 define a generally planar coke platform 27 which serves as the bottom of coke receiving box 10. The spaces 28 formed between adjacent channel members 26 define openings through which the gases in coke receiving box 10 may flow. Positioned just below the first set of channel members 26 is a second set of parallel generally U-shaped channel members 26*a* which are also mounted transverse to the length of coke receiving box 10. The flanges of channel members 26*a* are upwardly facing and slightly spaced-apart from the flanges of adjacent channel members 26*a*, in a manner similar to that of channel members 26, to form passages 28*a*. The ends of the flanges of channels 26*a* are in close proximity to but yet slightly spaced apart from the inner web of channels 26. Thus, gases may pass from the interior 11 of coke receiving box 10 via passages 28 and 28*a*. At the same time, passages 28 and 28*a* are of a width which prevents coke contained in coke receiving box 10 from passing therethrough.

Figure 3:
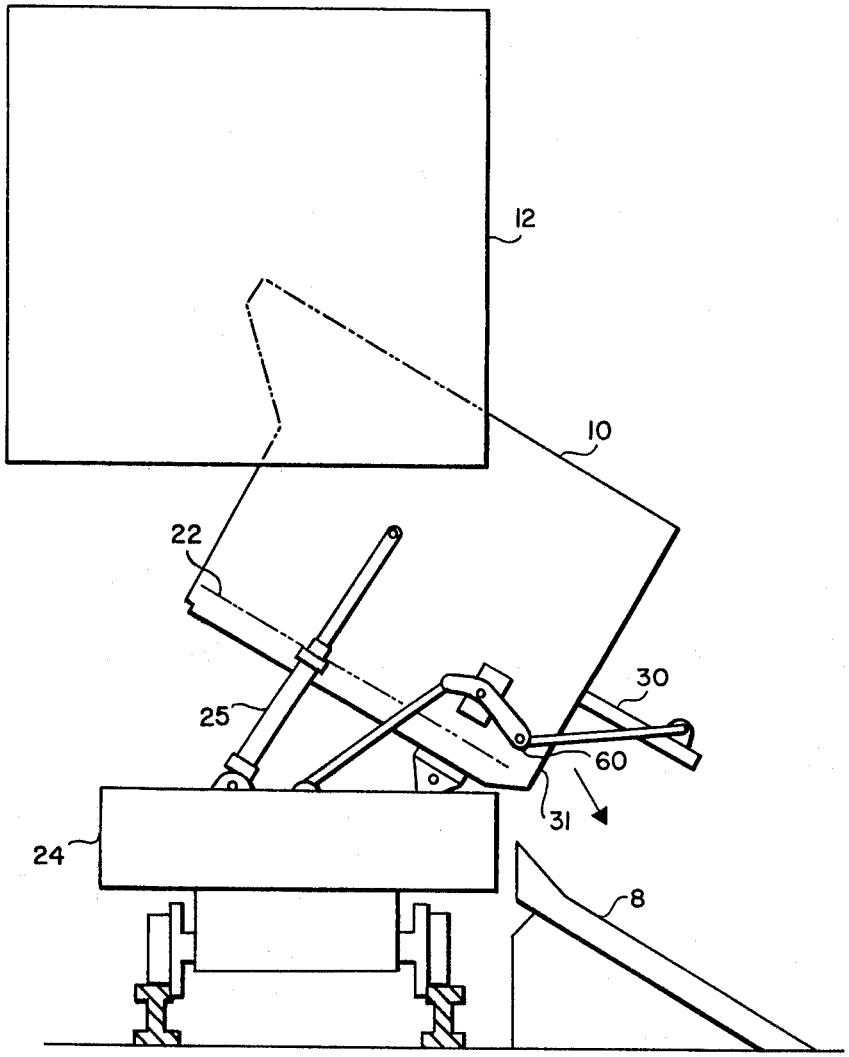
FIG. 3 is a side elevation of the coke quench car 2 of FIG. 1 showing coke receiving box 10 in a tilted position.

As shown in FIG. 3, coke receiving box 10 is pivotally mounted on coke car 2 in a manner such that grating 22 may be tilted at an angle from horizontal by a suitable tilting mechanism 25 to slope downward toward discharge door 30. In the illustrated embodiment, tilting mechanism 25 is an extensible hydraulic cylinder attached at one of its ends to quench car 2 and at its other end to coke receiving box 10 as shown. A linkage 60 is attached to discharge door 30 such that when receiving box 10 is tilted, door 30 opens to form coke dumping passage 31 which communicates with the interior of coke receiving box 10. The slope of grating 22 may be adjusted by the tilting mechanism 25 such that when discharge door 30 is open, coke resting on grating 22 will slide down the grating and be discharged from coke receiving box 10 through dumping passage 31 to the coke dumping wharf 8.

As shown in FIG. 2, mounted on quench car 2 below and in gaseous flow communication with coke receiving box 10 via the openings formed in grating 22 is gas discharge plenum 24. In the preferred embodiment, gas discharge plenum 24 is formed in the shape of a relatively shallow, open-topped tray. When pivotally-mounted coke receiving box 10 is in the non-tilted position illustrated in FIG. 2, for example when it contains hot coke, grating 22, which in the preferred embodiment forms the bottom of coke receiving box 10, is in a horizontal position and abuts against the top edges of discharge plenum 24 in sealing engagement to form a cover for the open top of the plenum 24. Thus, gases which pass from coke receiving box 10 through grating 22 enter discharge plenum 24.

Figure 5:
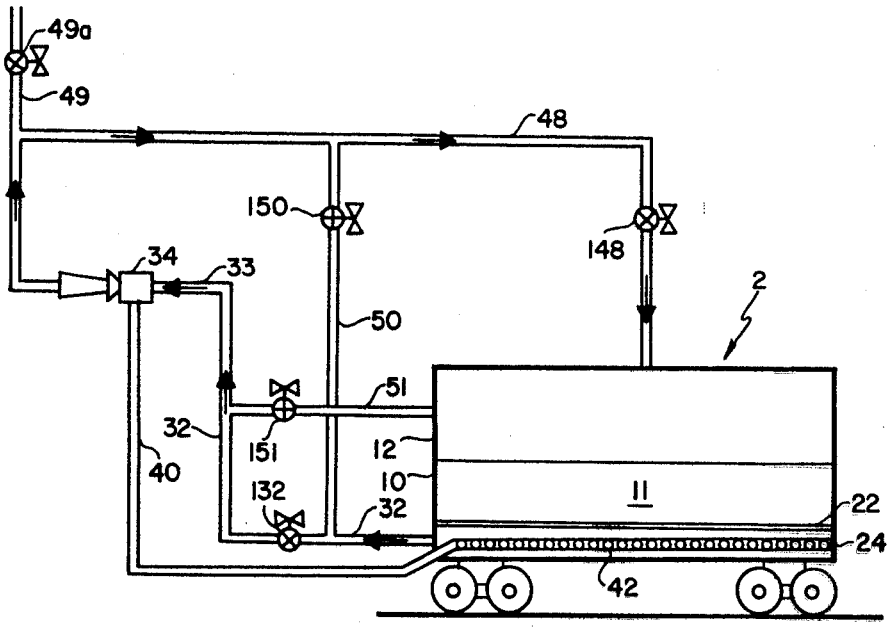
FIG. 5 is a schematic drawing of a coke quenching system according to the present invention wherein the gas flow is downward through the quench car.

Referring now to FIG. 5, a gas discharge duct 33 is connected in flow communication with gas discharge plenum 24 via intermediate duct 32. A draft inducer 34 is mounted to withdraw gases from gas discharge plenum 24 and preferably, as shown in FIG. 5, is located within gas discharge duct 33. Thus, draft inducer 34 is also in flow communication with coke receiving box 10 via discharge plenum 24 and draws gases downwardly from the interior of the coke receiving box 10, through coke grating 22 and gas discharge plenum 24, and through intermediate duct 32 into gas discharge duct 33. A gas cleaner may also be located within gas discharge duct 33 for cleaning the gases withdrawn from the interior of the coke receiving box 10.

Located in the gas flow path between the coke receiving box 10 and the draft inducer 34, and preferably, as shown in FIG. 4, located in gas discharge plenum 24 just below grating 22, is heat exchanger 42. Heat exchanger 42 includes an inlet header (not shown) for supplying water to the heat exchange tubes 43 and an outlet header 44 the discharge of which is connected to an energy accumulator (not shown) and to a steam turbine which in turn drives the draft inducer 34.

A recycle duct 48 provides flow communication between the downstream side of the draft inducer 34 and hood 12. Exhaust line 49 is in flow communication with recycle duct 48 and includes an exhaust control valve 49*a*, which enables a substantially constant gas pressure to be maintained.

As shown in FIG. 5, intermediate duct 32 has located therewithin intermediate duct damper 132. Similarly, recycle duct 48 has located therewithin recycle duct damper 148. Both intermediate duct damper 132 and recycle duct damper 148 are in the open position when coke is being pushed into coke receiving box 10. As further shown in FIG. 5, connected to provide flow communication between gas recycle duct 48 at a point downstream of draft inducer 34 and intermediate duct 32 at a point upstream of intermediate duct damper 132 is flow reversal duct 50. Located within flow reversal duct 50 is flow reversal duct damper 150. Connected to provide flow communication between intermediate duct 32 at a point downstream of intermediate duct damper 132 and hood 12 is alternate discharge duct 51. Located within alternate discharge duct 51 is alternate discharge duct damper 151. Both flow reversal duct damper 150 and alternate discharge duct damper 151 are in the closed position when coke is being pushed into coke receiving box 10.

As shown in FIG. 2, hood 12 may also be provided, preferably along its length, with a plurality of spray nozzles 50. Spray nozzles 50 are connected to a water source and are capable of spraying large volumes of water about the entire interior of coke receiving box 10 for purposes of wet quenching the hot coke contained therein, if such wet quenching is desired.

From the foregoing, the operation of the dry coke quenching system according to the present invention may now be readily understood. When a coke oven 7 in coke oven battery 6 is ready to be pushed, quench car 2, with plates 14 of hood 12 rotated inwardly, is positioned adjacent to the selected oven 7. Energy is then supplied to the draft inducer 34 from the energy accumulator, for example, steam energy from a steam accumulator. The incandescent coke is then pushed from the coke oven into coke receiving box 10 through opening 15.

During the push, all gaseous and particulate matter emissions generated by the push are drawn downwardly through the incandescent coke contained in coke receiving box 10 by the draft inducer 34. As these emissions pass through the incandescent coke, oxidation of the pollutants contained therein occurs and an inert combustion gas results. When the coke push is completed, plates 14 are rotated to their closed position and downward gas flow through the coke bed continues; oxygen is excluded from the system because hood 12 prevents the intrusion of air into receiving box 10. Thus, there is no further oxidation of the coke in the receiving box 10.

The hot, inert gases which are drawn downwardly from the bottom of coke receiving box 10 by draft inducer 34 pass through grating 22 and enter gas discharge plenum 24. These gases are cooled in discharge plenum 24 by exposure to heat exchanger 42 which is located therein. Preferably, the heat exchange medium utilized in heat exchanger 42 is water. It is believed that the heat extracted from the hot gases by heat exchanger 42 during a complete coke quenching cycle is sufficient to raise the total volume of water needed to operate the draft inducer 34 during the cycle to the required temperature. Thus, a substantial energy savings is realized by utilizing these gases to heat water for the operation of the draft inducer 34 and, thus, eliminating the need for an outside fuel source.

As further shown in FIG. 5, in the preferred embodiment, the cooled, cleaned inert gases which leave the downstream side of the draft inducer 34 are returned to hood 12 above coke receiving box 10 via recycle duct 48. A portion of these gases may be controllably exhausted to the atmosphere, or to storage for start-up purging, via exhaust line 49 by the proper positioning of exhaust valve 49*a*. No pollutants are introduced to the atmosphere by exhausting these inert gases since they have been cleaned prior to discharge. The cooled, inert gases which are returned to hood 12 are drawn downwardly through coke receiving box 10 in the manner described above to further cool the hot coke contained therein.

Figure 6:
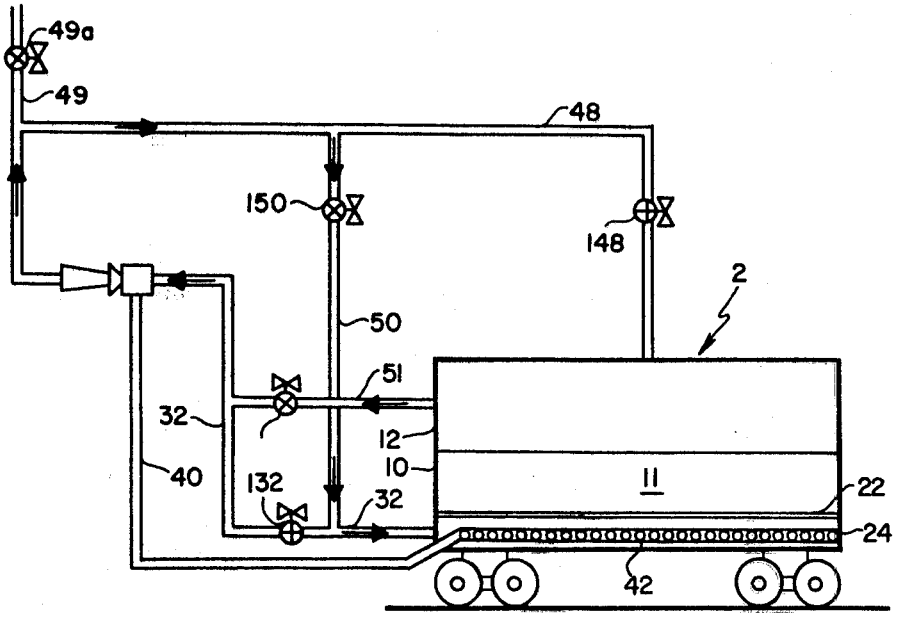
FIG. 6 is a schematic drawing of a coke quenching system according to the present invention wherein the gas flow is upward through the quench car.

As shown in FIG. 6, rerouting of the recycled gases for upward rather than downward flow through coke receiving box 10 may be accomplished by, at the desired moment, simultaneously closing normally open dampers 132 and 148 and opening normally closed dampers 151 and 150. Repositioning these four dampers in this manner causes the inert gases to pass from recycle duct 48 into gas discharge plenum 24 via flow reversal duct 50. Draft inducing means 34 then draws the gases upwardly through the coke contained in coke receiving box 10 and into gas discharge duct 33 via alternate gas discharge duct 51 for subsequent cleaning. The gases are cooled by heat exchanger 42 prior to upward passage through the hot coke. Upward gas flow as just described may be utilized if downward gas flow causes the temperature of the grating 22 to become excessive and cooling of the grating 22 is required for its protection. Those skilled in the art will understand that the just-described duct and damper arrangement is not critical to the instant invention and that many other gas flow designs could be used to accomplish gas flow reversal in the coke receiving box.

At any desired time, wet quenching may be initiated in coke receiving box 10 by introducing water thereto through spray nozzles 50. Thus, the initially dry-quenched coke may be further cooled by wet quenching in a closed system.

Figure 7:
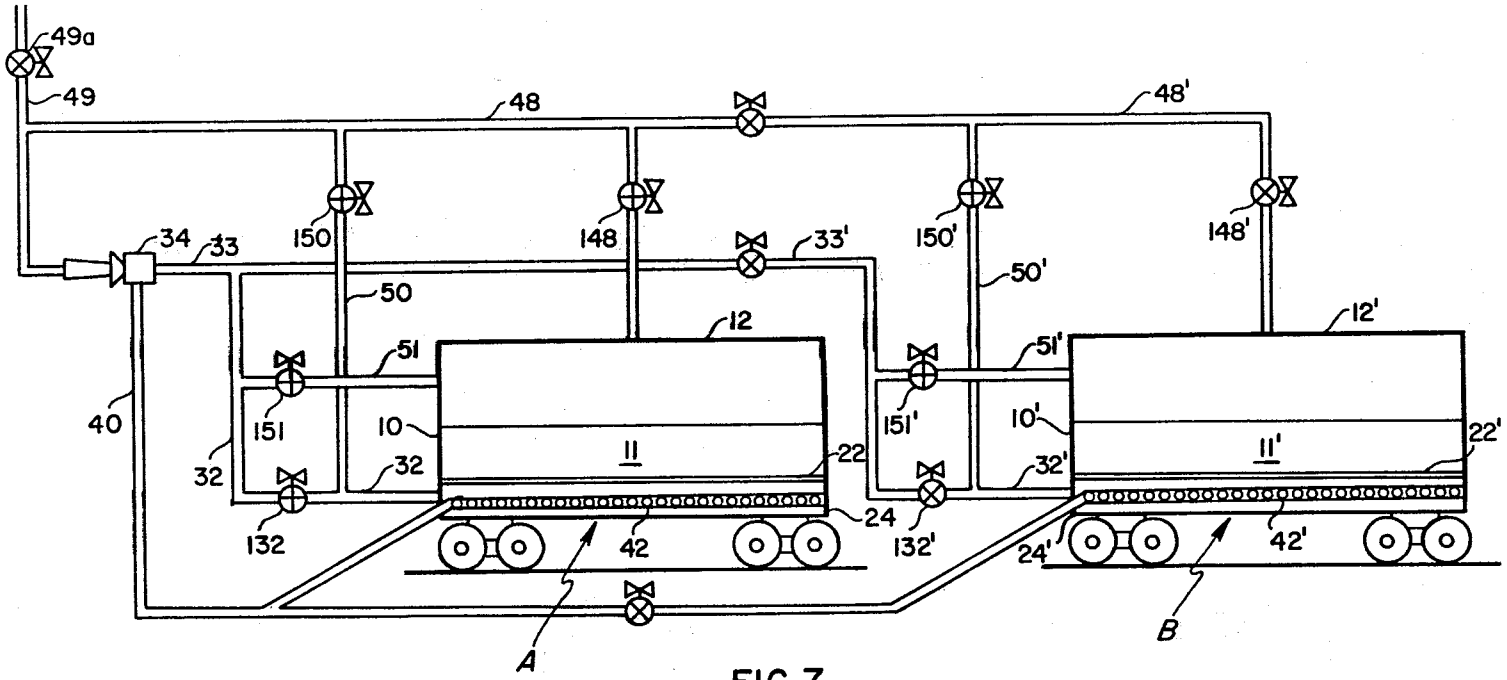
FIG. 7 is a schematic drawing of a modification of the coke quenching system according to the present invention; reference numerals which include a prime (') indicate elements identical with those of the quench car shown in FIGS. 5 and 6.

In a modification of the present invention, shown in FIG. 7, two quench cars identical to that described above, designated A and B, are positioned in end-to-end arrangement. It should be understood that the two cars could also be positioned at opposite ends of control car 4. The outlet end of gas discharge duct 33' of quench car B is connected in flow communication with gas discharge duct 33 of quench car A at a point upstream of draft inducer 34. Gas discharge duct 33' has damper Y located therein. The inlet end of recycle duct 48' of quench car B is connected in flow communication with recycle duct 48 of car A at a point downstream of draft inducer 34. Recycle duct 48' has damper X located therein. Dampers X and Y are operative to allow either quench car A or B to be selectively exposed to the influence of draft inducer 34.

The two-car system shown in FIG. 7 operates in the following manner. Quench car A, with plates 14 of hood 12 rotated inwardly, is positioned adjacent to a coke oven from which incandescent coke is to be pushed. A downward draft is induced, as described above, through the coke receiving box 10 of car A. The incandescent coke is then pushed into the coke receiving box 10 and plates 14 of car A are rotated to the closed position. As described above, recirculation of the inert gases through the coke bed from the downstream end of the draft inducer continues. The entire system then moves to the dumping wharf 8 where quench car B, which had previously been filled with coke which has now been quenched therein, is dumped.

After car B has been dumped, the system returns to the coke oven battery 6 for a coke push into the coke receiving box 10' of car B. When car B is in position to accept a new push, inert gas recirculation is terminated in car A and water is introduced to the spray nozzles 50 of car A to initiate wet quenching therein. Simultaneously, the appropriate dampers are repositioned to initiate downward gas flow in the coke box 10' of car B. More specifically, all of the dampers associated with car A, i.e., dampers 132, 148, 151 and 150, are closed so that car A is segregated from and only car B is exposed to the influence of draft inducer 34. Dampers X and Y, which were closed while dry quenching was in progress in car A, are opened to allow gases to be drawn from car B via discharge duct 33' as described above and returned to car B via recycle duct 48'. Dampers 132', 148', 151' and 150' of car B are, at this point in the quenching cycle, positioned as were the corresponding dampers of car A at the beginning of the quenching cycle in car A. Hot coke is then pushed into car B and the plates 14' of car B are rotated to the closed position. Recirculation of cooled, cleaned inert gases through the coke bed in car B continues. The system then proceeds to dumping wharf 8 to dump the quenched coke from car A. The system then returns to the coke oven battery 6 and the just-described cycle is repeated.

Those skilled in the art will readily recognize that the multiple quench car system just described provides a longer period of time, and thus greater temperature reduction of the coke, between the pushing of the coke into a particular quench car and the dumping of the coke from that car. Thus, it should be understood that the multiple car embodiment of the present invention is not limited to two quench cars but can include any number of quench cars sufficient to provide the time needed to cool the hot coke to the desired temperature.

Also, it should be understood that many duct and damper arrangements other than that described above can be used in the multiple quench car system.

I claim:

1. A mobile coke quenching apparatus for dry cooling hot coke while simultaneously substantially eliminating pollutants emitted during coke pushing and quenching operations comprising:

a. a mobile coke quench car having a coke receiving box mounted thereon for receiving hot coke and also having hood means mounted above said coke receiving box, said hood means including means for opening said hood to allow hot coke to be pushed into said receiving box and for closing said hood immediately thereafter to prevent the intrusion of air into said receiving box;

b. gas recirculation means connected at one of its ends to the bottom of said coke receiving box and at its other end to said hood means for recirculating gases through the interior of said receiving box;

c. draft inducing means mounted in said recirculation means for drawing gases from the interior of said receiving box downwardly through the hot coke contained in said receiving box to oxidize pollutants contained in said gases and hence, to produce an inert gas;

d. heat exchange means mounted in said recirculation means for removing heat from said inert gas; and e. exhaust valve means for maintaining a substantially constant gas pressure within said quench car.

2. A mobile coke quenching apparatus for cooling hot coke while simultaneously substantially eliminating pollutants emitting during coke pushing and quenching operations comprising:

a mobile coke quench car having a coke receiving box mounted thereon for receiving hot coke, a coke dumping passage formed in said receiving box in communication with the interior of said receiving box and a discharge door mounted on said car for opening and closing said dumping passage;

b. gas-tight hood means mounted above said receiving box, said hood means including means for opening said hood to allow hot coke to be pushed into said receiving box and for closing said hood to prevent both the intrusion of air into said receiving box and the escape of gases therefrom;

c. gas recirculation means connected at one of its ends to the bottom of said coke receiving box and at its other end to said hood means for recirculating gases through the interior of said receiving box;

d. a grating member forming the bottom of said coke receiving box and extending the length of said receiving box to separate the interior of said receiving box from said one end of said recirculation means, said grating member having formed therein openings which allow gases and particulate matter contained in the gases to flow between the interior of said receiving box and said one end of said recirculation means but prevent the passage of coke therebetween;

e. draft inducing means in flow communication with said recirculation means for drawing gases from the interior of said receiving box downwardly through the hot coke contained in said receiving box to oxidize pollutants contained in said gases and, hence, to produce an inert gas;

f. heat exchange means mounted in said recirculation means for removing heat energy from said inert gas; and g. exhaust valve means for maintaining a substantially constant gas pressure within said quench car.

3. An apparatus according to claim 2 further including an energy accumulator in communication with said heat exchange means for receiving said heat energy which has been removed from said inert gas.

4. The apparatus of claim 3 wherein said energy accumulator is in communication with said draft inducing means to provide energy for driving said draft inducing means.

5. An apparatus according to claim 4 further including gas cleaning means mounted in communication with said recirculation means for cleaning said inert gases.

6. A system for cooling hot coke while simultaneously substantially eliminating pollutants emitted during coke pushing and quenching operations comprising:

a. a plurality of mobile coke quench cars, each of said cars having a coke receiving box mounted thereon for receiving hot coke and also having hood means mounted above said coke receiving box, said hood means including means for opening said hood to allow hot coke to be pushed into said receiving box and for closing said hood immediately thereafter to prevent the intrusion of air into said receiving box;

b. gas recirculation means connected in flow communication with the bottom of each of said quench cars and with the hood means of each of said quench cars for recirculating gases through the interiors of said cars;

c. draft inducing means mounted in said recirculation means for withdrawing gases from the interior of said receiving boxes downwardly through the hot coke contained therein to oxidize pollutants contained in said gases and, hence, to produce an inert gas;

d. damper means mounted in said recirculation means, said damper means being operative to expose a selected quench car to the influence of said draft inducing means such that gases are withdrawn from said selected car and inert gas recirculated through the interior of said selected car;

e. heat exchange means located in said recirculation means for removing heat from said inert gas; and f. exhaust valve means for maintaining a substantially constant gas pressure within said selected quench car.

* * * * *